United States Patent [19]

Shea

[11] 4,174,860

[45] Nov. 20, 1979

[54] OVEN LATCH ASSEMBLY WITH ADJUSTABLE UNLOCKING TEMPERATURE SUB-ASSEMBLY

[75] Inventor: Christopher J. Shea, New Britain, Conn.

[73] Assignee: The Stanley Works, New Britain, Conn.

[21] Appl. No.: 833,304

[22] Filed: Sep. 14, 1977

[51] Int. Cl.[2] ..... E05C 5/02

[52] U.S. Cl. ..... 292/113; 292/210; 292/DIG. 60; 292/DIG. 66

[58] Field of Search ..... 292/210, DIG. 66, 97, 292/100, 113, DIG. 60, 1

[56] References Cited

U.S. PATENT DOCUMENTS

| | | | |
|---|---|---|---|
| 3,325,200 | 6/1967 | Fowler | 292/DIG. 69 |
| 3,438;666 | 4/1969 | Erickson | 292/210 |
| 3,476,424 | 11/1969 | Erickson | 292/DIG. 69 |
| 4,082,078 | 4/1978 | Thuleen et al. | 292/DIG. 69 |

*Primary Examiner*—Richard E. Moore

[57] ABSTRACT

A latch for ovens and the like includes a latch subassembly movable between latching and unlatching positions, a high temperature locking pawl engageable with the latch subassembly at a preselected elevated temperature to block its movement to unlatching position, and a thermal element which moves the locking pawl into blocking position. First adjustment means is provided to engage the locking pawl during its movement from a nonblocking position to the blocking position so as to locate its abutment surface in a predetermined position in the path of movement of the latch subassembly. Second adjustment means is also provided and is engageable with the locking pawl during its movement from blocking position to non-blocking position so as to locate the abutment surface on the pawl in a predetermined position. As a result, the length of the path of movement of the pawl between its two positions and the disposition of the pawl in its blocking position may be readily adjusted to compensate for variations in temperature conditions and thermal gradients between ovens and thermal elements in ovens of different models and manufacturers.

9 Claims, 8 Drawing Figures

OVEN LATCH ASSEMBLY WITH ADJUSTABLE UNLOCKING TEMPERATURE SUB-ASSEMBLY

BACKGROUND OF THE INVENTION

Many kitchen and commercial stoves now incorporate a self-cleaning feature in which the heat producing means can be activated to generate a very high temperature within the oven so as to produce substantially complete combustion of organic deposits upon the surfaces of the oven. Such temperatures frequently run as high as 380° Centigrade and above.

To ensure against inadvertent opening of the oven door while the oven is at elevated temperatures, a manual latch has been employed to latch the oven door in closed position, thus requiring a physical act in addition to grasping the handle of the door. However, concerns for user safety have led to the incorporation of various additional elements for latching the door in closed position during the high temperature portion of the cleaning cycle. Some such devices have used electrical interconnections between a solenoid engagable with the latch mechanism and circuitry controlling the high temperature phase of the appliance, particularly in the instance of electric ovens. Another approach has been the incorporation of a bimetallic strip responsive to the temperature in the oven and effective to move a pawl into a blocking position with respect to the latch subassembly, thereby preventing its movement from latched position to unlatched position when the bimetallic strip is exposed to preselected elevated temperatures. A device of this type is disclosed and described in detail in Erickson U.S. Pat. No. 3,438,666 granted Apr. 15, 1969.

To compensate for the temperature lag generally experienced between the temperature in the oven and that in the recess in which the bimetallic strip is disposed and the time lag between exposure of the bimetallic strip to the reduced temperature and the resultant movement of the blocking pawl during the cooling portion of the cycle, Siegel U.S. Pat. No. 3,540,767 granted Nov. 17, 1970 discloses and describes a clutch assembly in the operative connection between the bimetallic strip and the blocking pawl. As the blocking pawl rotates towards blocking position, it stops at a preselected point representing less rotation than that which might be effected by the bimetallic strip during the full heating cycle and there then occurs slippage as the bimetallic strip continues to expand. When the bimetallic strip begins to cool, it immediately begins to effect movement of the blocking pawl, thus compensating for the temperature lag since the amount of relative slippage may be controlled for the temperature lag experienced in a particular oven by proper dimensioning of the parts.

However, it has been found that the temperature characteristics of ovens vary widely from manufacturer to manufacturer and even from model to model of the same manufacturer. As a result, a set point for limiting rotation of the blocking pawl established in the latch assembly may not be satisfactory from one oven to the next. Moreover, movement in the unblocking direction from this set point may effect rotation of the blocking pawl to a point where there will be an increased and undesired distance of movement required in the next cleaning cycle to effect blocking of the operating mechanism.

It is an object of the present invention to provide an improved latch for ovens and the like with a high temperature latching subassembly with means for adjusting the points at which movement of the locking pawl will commence and terminate so as to permit use of the latch assembly in ovens having different thermal conditions.

It is also an object to provide such a latch which may be simply and economically constructed, which may be readily adjusted and which is rugged and durable in operation.

Another object is to provide such a latch wherein both the total travel of the locking pawl and its initial and final positions may be simply and readily varied.

SUMMARY OF THE INVENTION

It has now been found that the foregoing and related objects may be readily attained in a latch for ovens and the like which includes a support and a latch subassembly which is moved on the support between latching and unlatching positions. A high temperature locking pawl has an adjustment surface thereon which is engaged with the latch subassembly to block its movement for latching to unlatching positions, and means is provided to movably mount the locking pawl of the support.

A thermal element is operatively connected to the locking pawl and is responsive to locking temperatures to move the pawl from a first position wherein the abutment surface is removed from the path of movement of the latch subassembly from latching position to unlatching position and to a second position wherein the abutment surface is disposed in that path of movement of the latch subassembly to block its movement into unlatching position. The thermal element is also responsive to subsequent decline in temperature to move the pawl from its second position to its first position.

First adjustment means is movably mounted on the support and engagable with the locking pawl during its movement from the first position to the second position in order to locate its abutment surface in a predetermined position in the path of movement of the latch subassembly. Second adjustment means is movably mounted on the support and engagable with the locking pawl during its movement from the second position to the first position so as to locate the pawl abutment surface in a predetermined position spaced from the path of movement of the latch subassembly. The first and second adjustment means cooperate to limit the amount of movement of the pawl between the first and second positions and to define the location of the pawl in the first and second positions thereof. In this fashion, the latch may be adjusted for differing thermal conditions in a variety of ovens and the like.

In its preferred embodiment, the operative connection between the thermal element and the pawl includes yieldable means permitting movement of the pawl independently of movement of the thermal element after the pawl has engaged the first and second adjustment means. Desirably, the movable mounting means includes a shaft rotatably mounting the locking pawl on the support and the thermal element acts upon the shaft to effect rotation thereof. In this construction, the operative connection includes a member fixedly mounted in the shaft and extending along one horizontal surface of the pawl and means resiliently biasing the pawl against this means to produce frictional engagement therebetween whereby the pawl will normally move with this member upon rotation of the shaft in response to actuation by the thermal element. This connecting member is movable relative to the pawl upon engagement of the pawl with either of the first or second adjustment means whereby the biasing pressure maintaining the frictional engagement therebetween is overcome.

The first and second adjustment means are independently movable on the support. Most conveniently, the first adjustment means engages the abutment surface of the locking pawl to limit the movement of the pawl, and the second adjustment means includes a tab projecting from the surface thereof engagable with the pawl in its first position. Means is provided for locking the two adjustment means in predetermined positions to establish the first and second positions of the locking pawl.

DETAILED DESCRIPTION OF THE ILLUSTRATED EMBODIMENT

Figure 1:
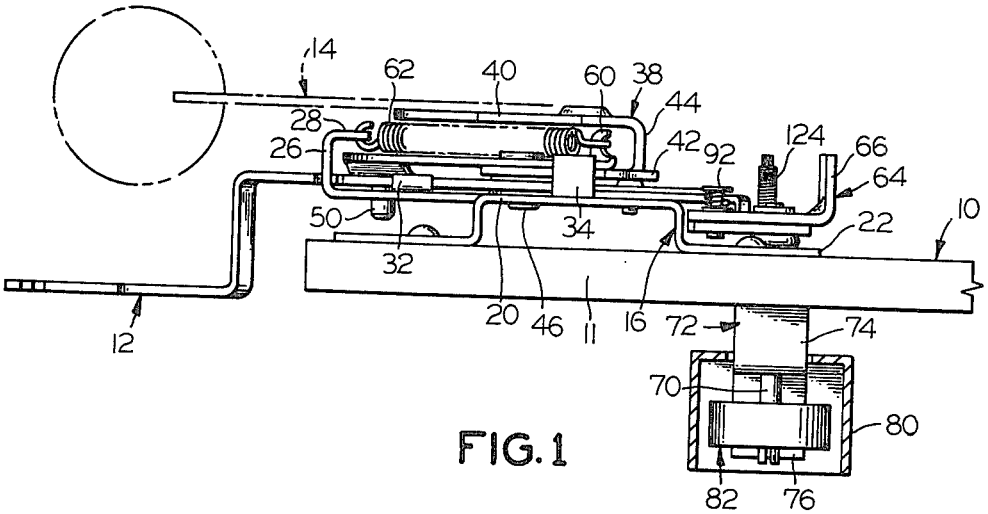
FIG. 1 is a side elevational view of an oven latch assembly employing the improved high temperature locking subassembly of the present invention with the handle shown in phantom line and with a portion of the appliance housing being fragmentarily illustrated.
Figure 2:
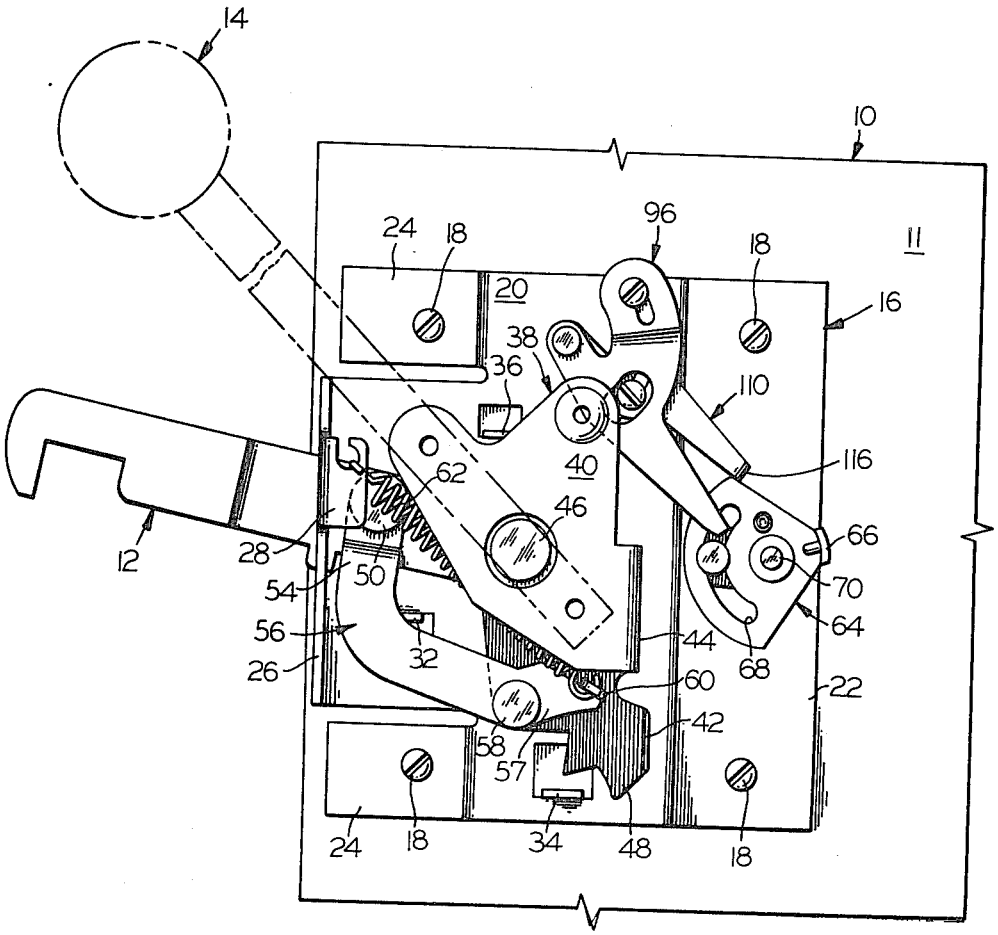
FIG. 2 is a top plan view of the assembly with the operating parts in the unlatched condition.

Turning now to the attached drawings in detail, FIGS. 1 and 2 illustrate the improved oven latching assembly of the present invention which is mounted upon a fragmentarily illustrated horizontal wall 11 of the appliance body generally designated by the numeral 10. As is customary, the wall 11 is spaced above the oven cavity (not shown). The handle generally designated by the numeral 14 is fragmentarily illustrated in phantom line and projects outwardly of the appliance body 10 above the oven door (not shown) and is used to mechanically move the latch arm generally designated by the numeral 12 into and from engagement with a strike plate (not shown) in the oven door (not shown).

The latch assembly includes the support plate generally designated by the numeral 16 which is secured to the wall 11 of the appliance body 10 by a plurality of fasteners 18. The support plate 16 is stamped or otherwise formed to provide an elevated platform portion 20 extending parallel to and spaced from the wall 11 of the appliance body 10. Along the end thereof spaced from the oven door (not shown), is a depending L-shaped flange 22 which seats upon the wall 11 and at the opposite end thereof are a pair of depending L-shaped legs 24 which also seat upon the wall 11, thus providing the means for securing the support plate 16 to the wall 11 by the fasteners 18. At the end of the platform portion 20 adjacent the door (not shown) is an upstanding wall 26 with a reversely bent finger 28 extending away from the door (not shown). The upstanding wall 26 has an elongated horizontally extending slot (not shown) through which the latch arm 12 extends and providing for pivotal movement thereof between the positions shown in FIGS. 2 and 3.

The metal of the platform portion 20 is staked upwardly to provide a series of three upstanding abutments 32,34,36 to limit movement of parts as described more fully herinafter.

Disposed upon the support plate 16 is the operating lever generally designated by the numeral 38 which includes a top plate 40, a bottom plate 42 extending parallel thereto and a U-shaped connecting web 44 at the end thereof spaced from the oven door (not shown). The bottom plate 42 includes an abutment arm portion 48 and is pivotally mounted upon the platform portion 20 of the support plate 16 by the pivot pin or rivet 46.

The latch arm 12 has an elongated slot (not shown) through which the pivot pin 46 extends to provide a sliding pivot connection therebetween and the platform portion 20 is provided with an arcuate slot (not shown) adjacent the upstanding wall 26 in which there is slidably disposed the depending cam follower pin 50 on the latch arm 12 to permit the controlled latching movement of the latch arm 12 during operation of the toggle mechanism.

Pivotally connected to the latch arm 12 by the cam follower pin 50 is one arm 54 of the toggle generally designated by the numeral 56. The other arm 57 is pivotally connected to the bottom plate 42 of the operating lever 38 by the pivot pin or rivet 58, and an upstanding finger 60 is provided on the end thereof. A tension spring 62 has one end thereof engaged with the upstanding finger 60 and the other end thereof engaged with the finger 28 on the upstanding wall 26 of the support plate 16. Thus, it can be seen that a toggle action is provided upon movement of the handle 14 to accelerate movement of the latch arm 12 into either open or latched positions and to apply substantial biasing pressure in either of such positions.

The general structure and operation of this type of mechanism is more fully described and illustrated in U.S. Pat. No. 3,438,666 granted Apr. 15, 1969 to K. H. Erickson.

Figure 4:
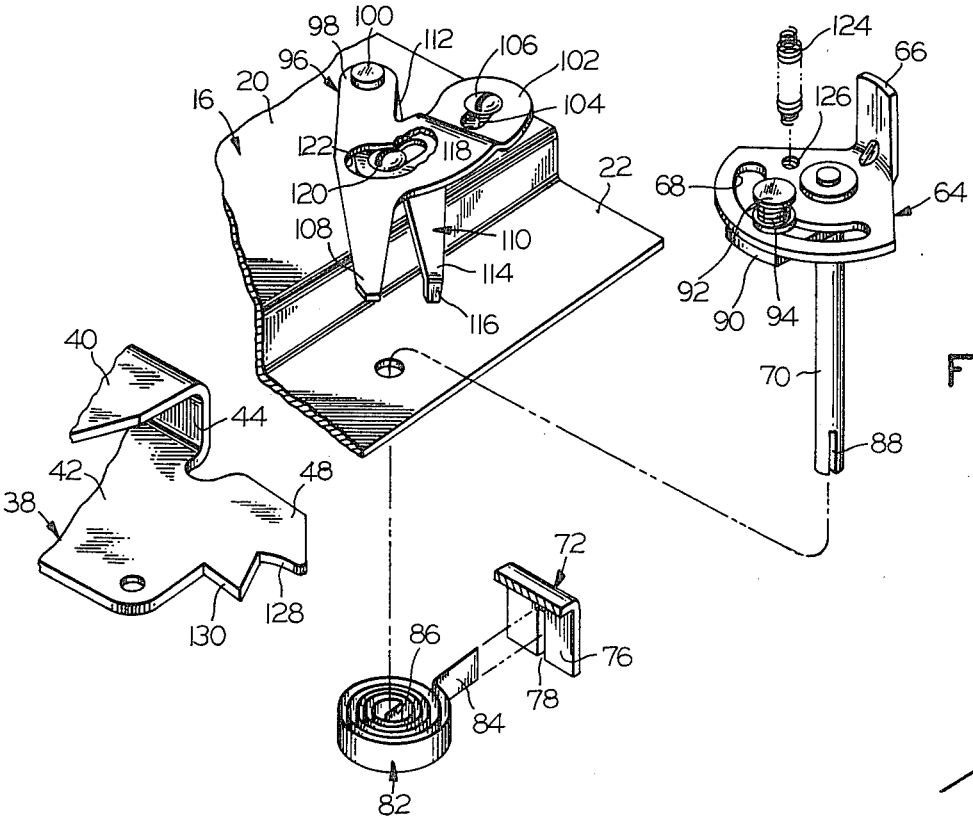
FIG. 4 is a fragmentary and partially exploded view of the high temperature locking subassembly, drawn on an enlarged scale.

As previously indicated, the oven latch assembly of the present inventtion employs an improved high temperature locking subassembly of the general type orginally disclosed in the aforesaid Erickson Patent and modified in U.S. Pat. No. 3,540,767 granted Nov. 17, 1970 to Charles L. Siegel. As in the case of the devices of the two prior patents, a blocking pawl generally designated by the numeral 64 is rotatably mounted on the upper end of the shaft 70 and includes an upstanding abutment arm 66 at one side thereof and an arcuate slot 68 adjacent the other side thereof. The shaft 70 extends through the support plate 16 and the wall 11 of the appliance body 10 and is journaled in the L-shaped mounting portion 74 of the support member generally designated by the numeral 72. The support member 72 also includes a reversely oriented L-shaped arm portion 76 extending laterally of the lower end of the shaft 70 with a perpendicularly extending slot 78 in the end thereof, as best seen in FIG. 4.

Disposed about the lower end of the shaft 70 on the horizontal surface of the arm portion 76 of the support member 72 is a coiled bimetallic strip generally designated by the numeral 82 having a linear outer end portion 84 engaged within the slot 78 of the support member 72. The inner end portion 86 of the bimetallic strip 82 is engaged in the axially extending slot 88 in the lower end of the shaft 70. A housing 80 is provided about the bimetallic strip 82 and has an open bottom so that it is readily exposed to the operating temperatures within the oven chamber (not shown) with which it is in communication. As a result, expansion of the bimetallic strip 82 occurring during heating will produce counterclockwise rotation of the shaft 70 as seen from above the shaft 70 since the outer end portion 84 is trapped, and cooling will produce clockwise rotation.

Nonrotatably mounted upon the upper end portion of the shaft 70 below the blocking pawl 64 is a clutch arm or plate 90 which extends under the arcuate slot 68. A headed pin 92 has its head portion disposed above the blocking pawl 64 and its shank portion extending downwardly through the arcuate slot 68 therein and fixed in the clutch plate 90. A compression spring 94 is disposed about the shank portion of the pin 92 and acts between the head portion thereof and the upper surface of the blocking pawl 64 about the slot 68 therein. As a result, the blocking pawl 64 is is biased firmly against the clutch plate 90 so as to produce frictional engagement therewith, whereby rotation of the shaft 70 and clutch plate 90 will normally produce equivalent rotation of the blocking pawl 64 although it is freely rotatable upon the shaft 70.

Supported upon the platform portion 20 of the support plate 16 is a locking temperature adjustment lever generally designated by the numeral 96 having a pivot end portion 98 pivotally mounted upon the support plate 16 by the pivot pin 100 and an abutment arm portion 108 at its other end. An arcuate arm portion 102 extends in the general direction of the pivot end portion 98 and has a downwardly offset section slidable on the support plate 16 and provided with an arcuate slot 104. Extending through the slot 104 and rotatably engaged in the support plate 16 is an adjustment screw 106 which secures the locking temperature adjustment lever 96 in any adjusted position thereof. As a result, the abutment arm portion 108 of the adjustment lever 96 may be disposed at a preselected position in the path of movement of the abutment arm 66 of the blocking pawl 64.

Disposed between the locking temperature adjustment lever 96 and the support plate 16 and slidable upon the support plate 16 is the unlocking temperature adjustment lever generally designated by the numeral 110 and having a pivot end portion 112 through which the pivot pin 100 extends. At its opposite end is an abutment arm portion 114 having a downwardly extending stop 116 for engagement with the side edge of the blocking pawl 64 as it rotates in the clockwise direction. An adjusting screw 120 is disposed within the slot 118 of the unlocking temperature adjustement lever 110 so as to secure it in the desired pivoted position thereof, and the locking temperature adjustment lever 96 is provided with an enlarged slot 122 so as to permit free movement about the head of the screw 120.

The blocking pawl 64 also has a coil spring 124 threadably engaged in the aperture 126 thereof and projecting upwardly therefrom. This spring 124 cooperates with the cam shoulder 130 on the abutment arm portion 48 of the operating arm lever 38 so as to effect rotation of the blocking pawl 64 under certain conditions to bring the abutment arm 66 into blocking relationship with the latch shoulder 128 on the abutment arm portion 48 of the operating lever 38 as will be described more fully hereinafter.

In normal operation of a stove embodying the latch assembly of the present invention, the latch mechanism will be in the position illustrated in FIG. 2. In this position, the latch arm 12 will not engage with the strike plate (not shown) of the oven door (not shown) so that the door may be opened and closed readily. Although the bimetallic strip 82 effects rotation of the shaft 70 and thereby the blocking pawl 64, the abutment arm 66 thereon will not engage the operating lever 38.

However, when it is desired to latch the oven door (not shown) in closed position, the handle 14 is moved from its phantom line position shown in FIG. 2 in a direction towards the bottom of the page as seen therein. This will effect operation of the toggle mechanism provided by the combination of the operating lever 38, toggle 56, and toggle spring 62 to produce the toggle action and move the operating lever 38 and latch arm 12 into the position shown in FIGS. 3 and 5. In this position, the operating lever 38 is limited from further rotation by the abutment 36. As will be readily appreciated, the latch arm 12 is firmly engaged with the strike plate (not shown) of the oven door (not shown) and its movement into this position is also somewhat inwardly relative to the support plate 16 so as to draw the door (not shown) inwardly and tightly against the door opening (not shown) of the appliance body 10.

Figure 3:
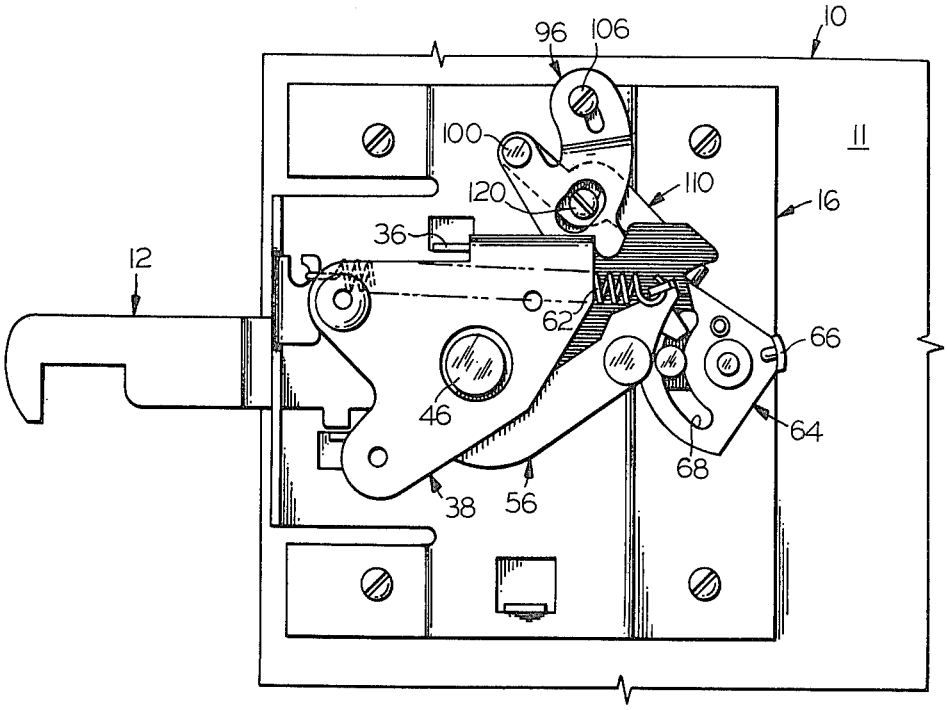
FIG. 3 is a view similar to FIG. 2 showing the operating parts moved into mechanical latching position but before the high temperature locking subassembly has been engaged.
Figure 5:
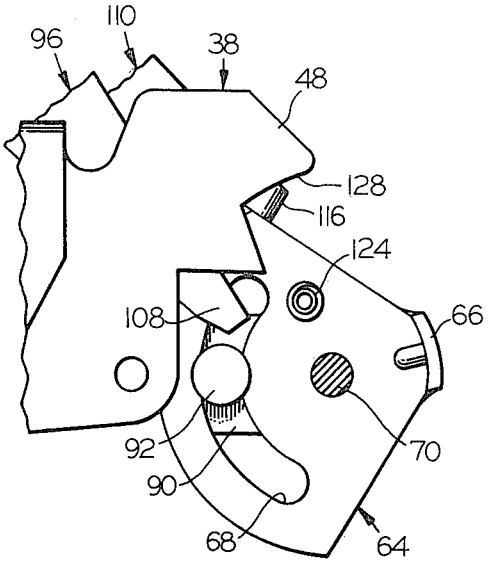
FIG. 5 is a partially diagrammatic view of the high temperature locking subassembly in the initial latched position of FIG. 3.
Figure 7:
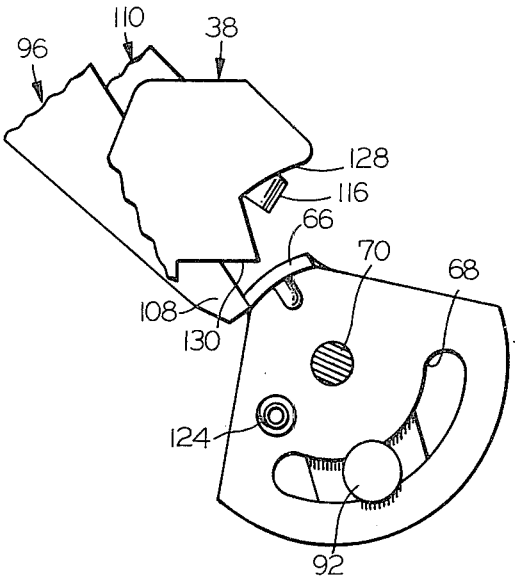
FIG. 7 is a similar view showing the high temperature locking pawl fully rotated into high temperature locking position and abutting the high temperature adjustment temperature lever.
Figure 6:
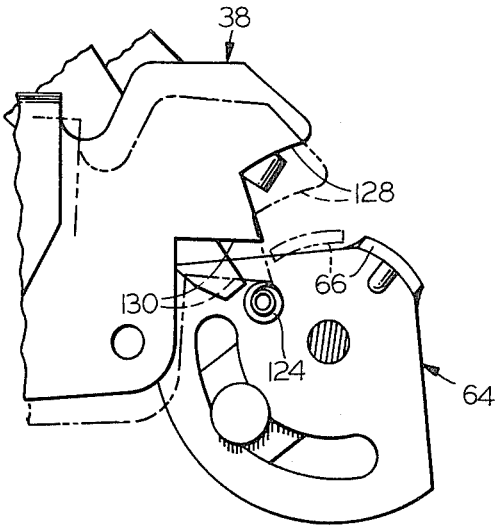
FIG. 6 is a similar view showing the high temperature locking pawl partially rotated and showing in phantom line a position of abutment arm portion of the operating lever if it is moved towards a door opening position.

With the latch arm 12 and operating lever 38 in the position shown in FIGS. 3 and 5, development of a high temperature in the oven will cause the bimetallic strip 82 to expand and produce rotation of the blocking pawl 64 in a counterclockwise direction as is shown in FIG. 6. As will be appreciated, the spring 94 is maintaining the clutch plate 90 and blocking pawl 64 in frictional engagement to effect this rotation of the blocking pawl 64. During continued rotation, the abutment arm 66 abuts against the abutment arm portion 108 of the locking temperature adjustment lever 96 as is seen in FIG. 7. At this point, the abutment arm 66 is positioned so as to prevent movement of the operating lever 38 and thereby the latch arm 12 into the door opening position of FIG. 2 since the shoulder 128 or the shoulder 130 on the lever 38 (depending upon the stop position established) will strike against and be restrained from further movement by the abutment arm 66.

Figure 8:
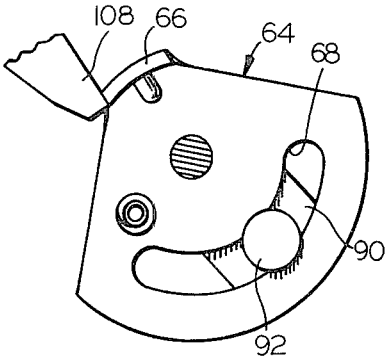
FIG. 8 is a view showing the effect of continued expansion of the bimetal to produce movement of the clutch assembly.

Continued expansion of the bimetallic strip 82 will continue to effect rotation of the shaft 70 and thereby the clutch plate 90. However, the biasing pressure of the spring 94 will be overcome, and the pin 92 will slide in the slot 68 in the blocking pawl 64 as is shown in FIG. 8.

This principle of operation is discussed in detail in the aforementioned Siegel patent and is used to compensate for the lag between cooling of the oven and contraction of the bimetallic strip 82 since the blocking pawl 64 will begin to rotate almost immediately upon cooling.

As will be appreciated, the rotation of the blocking pawl 64 into blocking position will lag somewhat behind the temperature in the oven and it is desirable to preclude opening of the oven door (not shown) as the temperatures approach the preset latching temperature.

As can be seen in FIG. 6, movement of the operating lever 38 from its full line latched position towards the opening position shown in phantom line will cause the cam shoulder 130 to bear against the upstanding spring 124 upon the blocking pawl 64. As a result, this engagement will rotate the blocking pawl 64 into a position where the abutment arm 66 is disposed in the path of the latch shoulder 128 upon the operating lever 38, thus precluding its movement suffiently to reverse the toggle mechanism and release the latch arm 12.

As explained in detail in the aforementioned Siegel patent, it is desirable to limit the amount of rotation of the blocking pawl 64 in response to expansion of the bimetallic strip 82 so that there will not be an excessive time lag between cooling of the oven to a temperature at which the door may be safely opened and the time when the abutment arm 66 will be moved from a position interfering with movement of the operating lever 38 to an opening position. Accordingly, as suggested in the aforementioned Siegel patent, the assembly of the present invention employs the locking temperature adjustment lever 96 against which the abutment arm 66 of the blocking pawl 64 abuts when the desired temperature of latching has been reached. Thereafter, further motion of the bimetallic strip 82 is absorbed by the relative motion between the clutch plate 90 and blocking pawl 64 as hereinbefore described. The positioning of the locking temperature adjustment lever 96 can be readily adjusted by loosening the adjustment screw 106, pivoting the lever 96 to the desired position, and tightening the adjustment screw 106 to maintain it in that position.

However, the assembly of the present invention also includes means for limiting the rotation of the blocking pawl 64 in the clockwise direction during cooling of the bimetallic strip 82. This feature is provided by the unlocking temperature adjustment lever 110 which may be pivoted about the pivot pin 100 into a range of positions in the path of clockwise movement of the blocking pawl 64 so that its stop 116 will engage the leading edge of the blocking pawl 64 in such clockwise movement and thereby prevent further clockwise rotation. Continued cooling of the bimetallic strip 82 and thereby rotation of the shaft 70 will be accommodated by sliding of the clutch pin 92 within the slot 68 of the blocking pawl 64.

Varying the pivoted locations of the locking temperature adjustment lever 96 and unlocking temperature adjustment lever 110 will vary the amount and path of oscillation of the blocking pawl 64 and thereby its abutment arm 66. Since movement of the blocking pawl 64 in the counterclockwise direction from the unlocking temperature adjustment lever 110 will be effected immediately upon rotation of the shaft 70 by the bimetallic strip 82 during heating, and conversely, since the movement of the blocking pawl 64 in a clockwise direction will occur immediately upon contraction of the bimetallic strip 82 during cooling, the positioning of these two levers enables adjustment of the latch assembly to render it effective for a wide variety of ovens with different heating and cooling rates and different lags in temperature response by the bimetallic strip 82.

In the illustrated embodiment, both adjustment levers are elongated and pivoted upon the support plate adjacent one end so that they pivot into their various adjusted positions. However, it will be readily appreciated that the adjustment levers may be slidable in the desired direction of movement to achieve the desired result. Moreover, if so desired, the two levers may be movable together or independently by provision of suitable means for releasably locking the two levers together.

As will be readily appreciated, other configurations and constructions for the several specifically illustrated elements may be employed while achieving the desired result. Desirably, the several components are fabricated from metals which are adapted to withstand repeated heat cycling, and the parts may be readily fabricated by stamping and punching from such metals.

The latches of the present invention may be utilized with a variety of ovens made by different manufacturers and utilizing different forms of energy and they may also be employed in different models of the same manufacturer since there is incorporated means for effecting adjustment of the locking and unlocking positions of the blocking pawl for any given oven. To establish the positions of the adjustment levers and thereby the pawl at its two points of movement, a latch may be incorporated in a test appliance and the oven heated to a preselected temperature to establish the position of the pawl in response to actuation of the bimetallic element by the temperature within the oven. The first adjustment lever is then set to stop the pawl from further rotation at this point. Since the initial position of the blocking pawl may be noted, the second adjustment lever may be utilized to establish the unlocking temperature position of the pawl and thereby to determine the amount of rotation of the pawl between its two positions. It will be appreciated that variations of the procedure may be employed if so desired.

From the foregoing detailed specificatiion and drawings, it will be appreciated that the latch of the present invention incorporates a highly advantageous high temperature latch subassembly which permits adjustment of the points of commencement and termination motion of the blocking pawl in response to actuation by the thermal element. This permits use of the latch assembly in ovens having differing thermal conditions. The components may be simply and economically fabricated and may be readily adjusted for a given oven to provide a latch which is rugged and durable in operation. Thus, the latch provides means both for limiting the total travel of the blocking pawl and for establishment of its initial and final positions.

Having thus described the invention, I claim:

1. A latch for ovens and the like comprising:

A. a support;

B. a latch subassembly movable on said support between latching and unlatching positions;

C. a high temperature locking pawl having an abutment surface thereon engagable with said latch subassembly to block its movement from latching to unlatching position;

D. means movably mounting said locking pawl on said support;

E. a thermal element operatively connected to said locking pawl and responsive to elevated temperatures to move said pawl from a first position wherein said abutment surface is removed from the path of movement of said latch subassembly from latching position to unlatching position to a second position wherein said abutment surface is disposed in said path of movement of said latch subassembly to block its movement into unlatching position, said thermal element being responsive to subsequent decline in temperature to move said pawl from said second position to said first position;

F. first adjustment means movably mounted on said support and engageable with said locking pawl during its movement from said first position to said second position to locate said abutment surface in a predetermined position in said path of movement of said latch subassembly; and G. second adjustment means movably mounted on said support and engagable with said locking pawl during its movement from said second position to said first position to locate said abutment surface in a predetermined position spaced from said path of movement of said latch subassembly, said first and second adjustment means cooperating to limit the amount of movement of said pawl between said first and second positions and defining the location of said pawl in said first and second positions, whereby the latch may be adjusted for differing thermal conditions in a variety of ovens and the like.

2. The latch in accordance with claim 1 wherein said operative connection between said thermal element and said pawl includes yieldable means permitting movement of said pawl independently of movement of said thermal element when said pawl engages said first and second adjustment means.

3. The latch in accordance with claim 1 wherein said movable mounting means include a shaft rotatably mounting said locking pawl on said support and said thermal element acts upon said shaft to effect rotation thereof.

4. The latch in accordance with claim 3 hwerein said operative connection between said thermal element and said pawl includes a yieldable connection permitting movement of said pawl independently of movement of said thermal element when said pawl engages said first and second adjustment means.

5. The latch in accordance with claim 3 wherein said yieldable connection includes a member fixedly mounted on said shaft and extending along one horizontal surface of said pawl, and means resiliently biasing said pawl against said member to produce frictional engagement therebetween whereby said pawl will normally move with said member upon rotation of said shaft in response to action of said thermal element, said member being movable relative to said pawl upon engagement of said pawl with said first and second adjustment means, whereby the biasing pressure maintaining frictional engagement therebetween is overcome.

6. The latch in accordance with claim 1 wherein said first and second adjustment means are independently movable on said support.

7. The latch in accordance with claim 1 wherein said first adjustment means engages said abutment surface of said locking pawl to limit the movement of said pawl.

8. The latch in accordance with claim 1 wherein said second adjustment means includes a tab projecting from the surface thereof and engagable with said pawl in said first position thereof.

9. The latch in accordance with claim 1 wherein said first and second adjustment means include means for locking said adjustment means in predetermined positions to establish said first and second positions of said locking pawl.

* * * * *